US005888559A

United States Patent [19]

Akins et al.

[11] Patent Number: 5,888,559

[45] Date of Patent: Mar. 30, 1999

[54] PRESS FOR COMPACTING PLASTIC EXPLOSIVE MATERIAL

[75] Inventors: Frank Terrell Akins; Henry Sproul McDevitt, Jr., both of Vicksburg, Miss.

[73] Assignee: The United States of America as represented by the Secretary of the Army, Washington, D.C.

[21] Appl. No.: 929,914

[22] Filed: Sep. 15, 1997

[51] Int. Cl.[6] ..... B30B 1/04

[52] U.S. Cl. ..... 425/457; 264/3.1; 425/469

[58] Field of Search ..... 264/3.1; 425/457, 425/469

[56] References Cited

U.S. PATENT DOCUMENTS

| | | | |
|---|---|---|---|
| 1,371,656 | 3/1921 | Whitney | 425/457 |
| 2,865,208 | 12/1958 | Wacht | 425/457 |
| 3,129,463 | 4/1964 | Gill, Jr. et al. | 425/457 |
| 4,695,414 | 9/1987 | Forslund et al. | 264/3.1 |
| 4,767,577 | 8/1988 | Muller et al. | 264/3.3 |
| 4,920,079 | 4/1990 | Kaeser et al. | 264/3.1 |
| 5,354,519 | 10/1994 | Kaeser | 264/3.1 |

*Primary Examiner*—Mary Lynn Theisen
*Attorney, Agent, or Firm*—Luther A. Marsh

[57] ABSTRACT

A press for compacting plastic explosive materials comprises a base plate, a support column upstanding from the base plate, a tubular housing mounted on an upper end of the column and extending widthwise of the column, a slide member slidably moveable in the tubular housing substantially parallel to the base plate and an elongated handle pivotally mounted at a distal end thereof on the slide member. A press piston is slidably disposed in a bore in the slide member and is slidably moveable in directions normal to the slide member, a distal end of the piston being disposed over the base plate, the piston having at a proximal end thereof a handle housing through which extends the handle, the handle housing having first and second rollers therein with the handle disposed between the rollers. Pivotal movement of the handle is operative to move the piston reciprocally toward and away from the base plate.

16 Claims, 2 Drawing Sheets

PRESS FOR COMPACTING PLASTIC EXPLOSIVE MATERIAL

BACKGROUND OF THE INVENTION

1. Field of the Invention

This invention relates to compaction and molding of plastic explosives and is directed more particularly to a press for compacting such plastic explosives.

2. Description of the Prior Art

In the production of shaped charges and explosive formed penetrators (EFP), thin strips of plastic explosives are manually packed into a mold, utilizing wood dowels and brass hammers. Manual packing is utilized for safety reasons, namely avoidance of heat and sparks in the packing process. Such process is necessarily tedious and slow. Further, the plastic explosive often is over or under compacted.

There is a need to standardize the compactive effort for more uniform compaction. There is further a need for compaction in a more time-efficient manner.

SUMMARY OF THE INVENTION

An objective of the invention is, therefore, to provide a portable press device operated by hand but uniform in compaction and more time-efficient than the current manual process.

With the above and other objects in view, as will hereinafter appear, a feature of the present invention is the provision of a press for compacting plastic explosive materials, the press comprising a base plate, a support column upstanding from the base plate, a tubular housing mounted on an upper end of the column and extending widthwise of the column, and a slide member slidably moveable in the tubular housing substantially parallel to the base plate. An elongated handle is pivotally mounted at a distal end thereof on the slide member. A press piston is slidably disposed in the slide member and is slidably moveable in directions normal to the slide member, a distal end of the piston being disposed over the base plate, the piston having at a proximal end thereof a roller housing through which extends the handle, the roller housing having first and second rollers therein with the handle disposed between the rollers. Pivotal movement of the handle is operative to move the piston reciprocally toward and away from the base plate.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
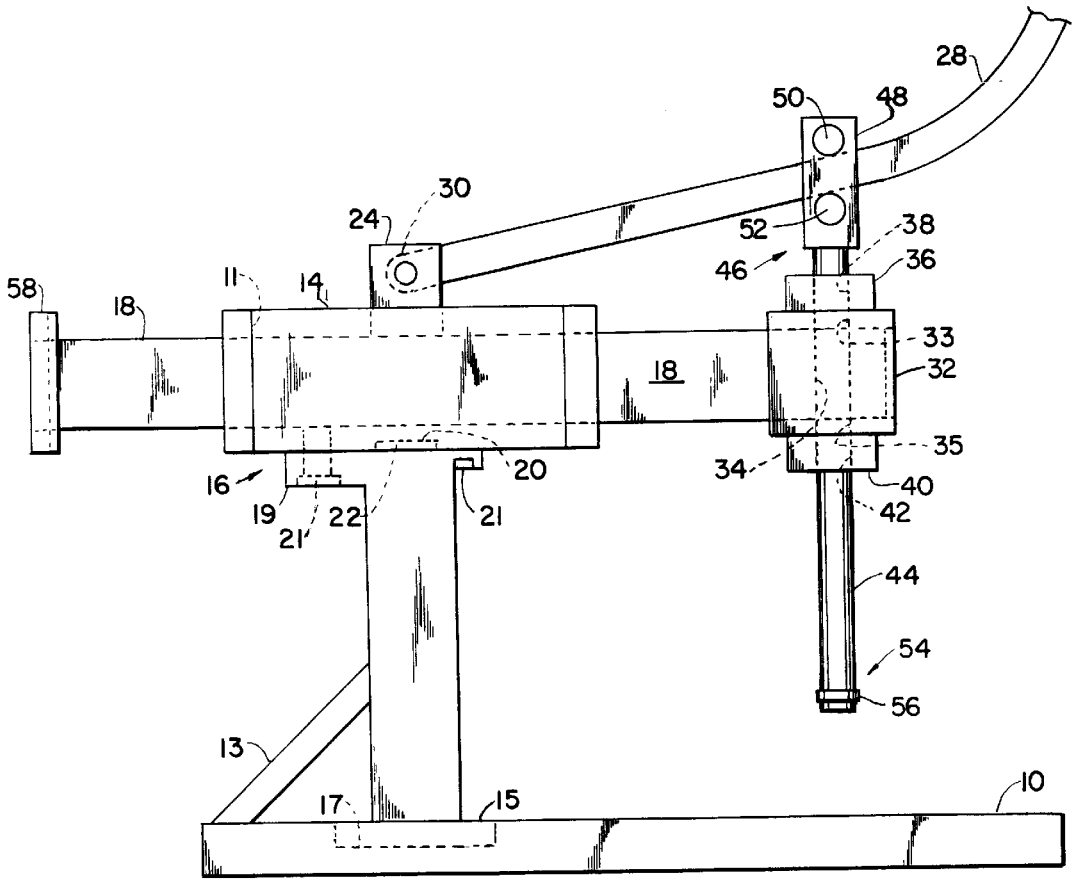
FIG. 1 is a side elevational view of one form of press illustrative of an embodiment of the invention.
Figure 2:
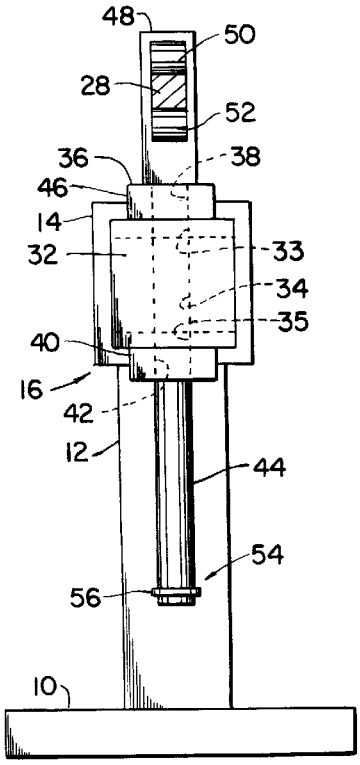
FIG. 2 is a front elevational view of the press of FIG. 1.

Referring to FIGS. 1 and 2, it will be seen that an illustrative press includes a base plate 10 for fixing to a stable surface, such as the top of a sturdy wooden table (not shown). The base plate 10 may be secured to the table top by non-sparking C-clamps (not shown), or the like. In a preferred embodiment, the base plate 10 is about 24 inches in length, about 12 inches in width, and about 2 inches in thickness.

A support column 12 upstands from the base plate 10 substantially normal to the base plate. The support column 12 may be supported by a truss 13. In the aforementioned preferred embodiment, the support column 12 is about 4×4 inches widthwise thereof. The column 12 preferably includes a footing 15 fixed in a recess 17 in the base plate 10. In the preferred embodiment, the footing 15 is about 6×6×1 inches and the recess 17 is shaped and sized complementarily.

Figure 3:
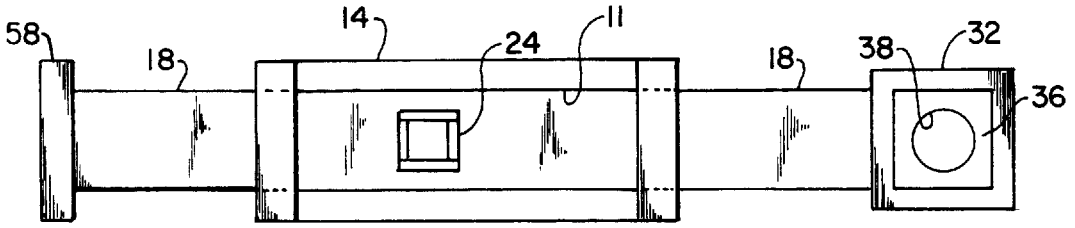
FIG. 3 is a top plan view of a portion of the press.
Figure 4:
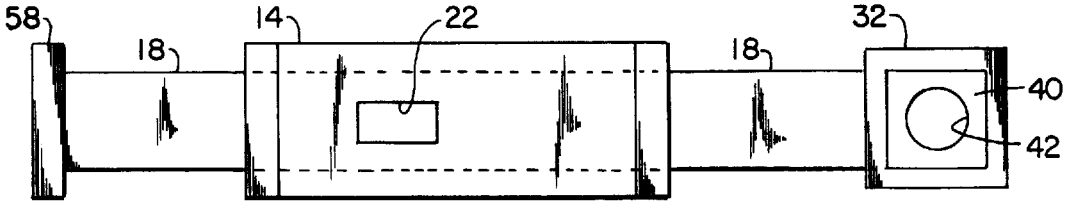
FIG. 4 is a bottom plan view of the press portion of FIG. 3.

A tubular housing 14 (FIGS. 1–4) is fixed on an upper end 16 of the column 12, as by a column key 20 fixed in a tubular housing recess 22. The tubular housing 14 is open at the top, an opening 11 being defined, in the embodiment illustrated, by side walls 26 and end walls 27 of the housing 14 (FIG. 3). Preferably, the support column 12 is, at the upper end 16 thereof, provided with a lateral extension 19 for further supporting the tubular housing 14. The tubular housing may be further affixed to the support column extension 19 by screws 21, or other fasteners. The tubular housing 14, in the preferred embodiment, is about 6×6 inches widthwise thereof, with walls of about one inch thickness. The tubular housing 14, in the aforementioned embodiment, is about 12 inches in length, and extends substantially parallel to the base plate 10.

An elongated slide member 18 is slidably disposed in, and movable in, the tubular housing 14. In the preferred embodiment, the slide member 18 is about 24 inches long and about 4×4 inches in widthwise cross-section. Inasmuch as the tubular housing 14 is about 6×6 inches externally and includes walls of about one inch thickness, there is provided a 4×4 inch internal channel for slidably retaining the slide member 18.

A handle support 24 extends upwardly from the slide member 18 through the opening 11 in tubular housing 14. An elongated handle 28 is pivotally mounted at a distal end 30 thereof on the handle support 24. The handle 28 preferably is about 1.5×1.5 inches in cross-section.

A piston housing 32 is fixed on an end of the slide member 18. The housing 32 includes bores 33, 35 aligned with a bore 34 extending through the slide member 18. An upper head 36 is fixed to an upper end of the housing 32 and is provided with a bore 38 in alignment with the piston housing bore 33 and the slide member bore 34. Similarly, a lower head 40 is fixed to a lower end of the housing 32 and is provided with a bore 42 in alignment with the other piston housing bores 35 and the slide member bore 34.

A press piston 44 is slidably disposed in the bores 38, 33, 34, 35, 42 which extend substantially normal to the base plate 10. Thus, the press piston 44 is slidably moveable vertically in the bores 38, 33, 34, 35, 42. At a proximal end 46 of the press piston 44 there is fixed to the press piston a handle housing 48. A pair of roller bearings 50, 52 are mounted in the handle housing 48, with the handle 28 extending therebetween, as shown in FIGS. 1 and 2. In the preferred embodiment, the roller bearings 50, 52 are of about one inch diameter.

At a distal end 54 of the press piston 44 there is fixed to the press piston a ring 56, or other connector, for securing tools (not shown) to the press piston 44.

The parts of the press, including fasteners, are constructed of a non-sparking material, such as a combination of aluminum and brass, or other aluminum alloy. The handle and other exposed parts, may be coated with rubber.

In use, the press is mounted on a flat non-sparking platform, such as a wooden table top. A mold or EFP (not shown) is fixed to the base plate 10. By movement of the slide member 18 in the housing 14, the press piston 44 is moved lengthwise of the base plate 10, to position the press piston over the area in which compaction is desired. The movement of the slide member 18 is limited by the piston housing 32 on one end of the slide member and an end plate 58 fixed on the other end of the slide member. If not done previously, a selected tool is secured to the press piston distal end 54.

Thin strips of plastic explosive are placed in a mold or EFP mounted on the base plate 10. An operator then manipulates the handle 28 in an up-and-down motion. The handle 28 pivots on the handle support 24. The handle housing 48 rides along the handle 28 and effects vertical movement of the press piston 44 in response to the pivotal motion of the handle. The downward strokes of the press piston 44 effect compaction of the plastic explosive material.

There is thus provided means for more precisely hand packing of the explosive material, for providing less variance in density of compacted material after packing, less distortion of the explosive, and less chance of accidental detonation. The press described herein provides more consistent results than do current practices.

It is to be understood that the present invention is by no means limited to the particular construction herein disclosed and/or shown in the drawings, but also comprises any modifications or equivalents within the scope of the claims.

What is claimed is:

1. A press for compacting plastic explosive materials, said press comprising:

a base plate;

a support column upstanding from said base plate;

a tubular housing mounted on an upper end of said support column and extending widthwise of said support column;

a slide member slidably moveable in said tubular housing;

a handle pivotally mounted at a distal end thereof on said slide member;

a press piston mounted on said handle and extending through a bore in said slide member and toward said base plate;

wherein pivotal movement of said handle on said slide member is operative to move said press piston in said slide member bore toward and away from said base plate.

2. The press in accordance with claim 1 and further comprising a piston housing fixed on said slide member and having bore means aligned with said slide member bore, said press piston extending through said piston housing bore means and said slide member bore.

3. The press in accordance with claim 1 further comprising a handle support extending from said slide member through an opening in said tubular housing, said handle being pivotally mounted on said handle support.

4. A press for compacting plastic explosive materials, said press comprising;

a base plate;

a support column upstanding from said base plate;

a tubular housing mounted on an upper end of said column and extending widthwise of said column;

an elongated slide member slidably moveable in said tubular housing substantially parallel to said base plate;

a handle support extending from said slide member through an opening in said tubular housing;

an elongated handle pivotally mounted at a distal thereof on said handle support;

a piston housing fixed on said slide member; and a press piston slidably disposed in said piston housing and slidably moveable in directions normal to said elongated slide member, a distal end of said piston being disposed over said base plate, said piston having at a proximal end thereof a handle housing through which extends said handle, and first and second rollers disposed in said handle housing with said handle extending between said rollers;

wherein pivotal movement of said handle on said handle support is operative to move said distal end of said piston reciprocally toward and away from said base plate.

5. The press in accordance with claim 4 wherein said support column is provided with a width-wise extension at an upper end thereof, and said tubular housing is fixed to said extension.

6. The press in accordance with claim 4 wherein said tubular housing is open at a top thereof.

7. The press in accordance with claim 6 wherein said opening in said tubular housing comprises said open top of said tubular housing, said open top being defined by tubular housing side walls and end walls.

8. The press in accordance with claim 4 wherein said piston housing is fixed on one end of said slide member.

9. The press in accordance with claim 8 wherein an end plate is fixed to the other end of said slide member, said end plate being larger width-wise than said slide member, to limit axial movement of said slide member in one direction.

10. The press in accordance with claim 8 wherein said piston housing is provided with bore means in alignment with a bore extending through said slide member, said press piston being slidably disposed in said piston housing bore means and said slide member bore.

11. The press in accordance with claim 4 wherein said distal end of said press piston is provided with a connector for fixing a tool on said distal end of said press piston.

12. The press in accordance with claim 11 wherein said connector comprises a ring extending outwardly from said press piston.

13. The press in accordance with claim 4 wherein all components of said press are of a non-sparking material.

14. The press in accordance with claim 13 wherein said non-sparking material comprises an aluminum alloy.

15. The press in accordance with claim 14 wherein said aluminum alloy includes brass.

16. The press in accordance with claim 14 wherein exposed portions of selected ones of said parts are coated with rubber.

* * * * *